US006941777B2

(12) United States Patent
Iwamoto

(10) Patent No.: US 6,941,777 B2
(45) Date of Patent: Sep. 13, 2005

(54) BAGGAGE

(75) Inventor: Shingo Iwamoto, Yokohama (JP)

(73) Assignee: Vanguard Corporation, Yokohama (JP)

( * ) Notice: Subject to any disclaimer, the term of this patent is extended or adjusted under 35 U.S.C. 154(b) by 0 days.

(21) Appl. No.: 10/856,433

(22) Filed: May 27, 2004

(65) Prior Publication Data

US 2004/0237606 A1 Dec. 2, 2004

(30) Foreign Application Priority Data

May 30, 2003 (JP) ..... 2003-156001

(51) Int. Cl.[7] ..... A45C 13/10

(52) U.S. Cl. ..... 70/69; 70/207; 70/70; 70/18; 70/30; 190/101

(58) Field of Search ..... 70/64–67, 69–76, 70/30, 49, 233, 207, 208, 21–224; 190/101, 102, 119

(56) References Cited

U.S. PATENT DOCUMENTS

| | | | | | |
|---|---|---|---|---|---|
| 338,846 | A | * | 3/1886 | Kimber | 190/101 |
| 359,219 | A | * | 3/1887 | Lyon | 190/101 |
| 672,173 | A | * | 4/1901 | Le Fevre | 190/102 |
| 1,367,043 | A | * | 2/1921 | Haskell | 190/101 |
| 1,586,113 | A | * | 5/1926 | Pedersen | 190/101 |
| 2,556,324 | A | * | 6/1951 | Fiorucci | 190/119 |
| 2,708,989 | A | * | 5/1955 | Bogdanski | 16/111.1 |
| 4,066,195 | A | * | 1/1978 | Dickler | 224/153 |
| 4,366,685 | A | * | 1/1983 | Remington | 70/70 |
| 4,395,892 | A | * | 8/1983 | Remington | 70/312 |
| 4,738,341 | A | * | 4/1988 | Asano | 190/101 |
| 4,756,171 | A | * | 7/1988 | Homar | 70/18 |
| 4,817,403 | A | * | 4/1989 | Dimmick | 70/69 |
| 4,896,517 | A | * | 1/1990 | Ling | 70/18 |
| 5,156,028 | A | * | 10/1992 | Jiang | 70/30 |
| 5,713,226 | A | * | 2/1998 | Yu | 70/69 |
| 5,762,169 | A | * | 6/1998 | Deliman et al. | 190/101 |
| 5,768,920 | A | * | 6/1998 | DeBevoise | 70/18 |

FOREIGN PATENT DOCUMENTS

| | | |
|---|---|---|
| JP | 11-155623 | 6/1999 |

* cited by examiner

*Primary Examiner*—Suzanne Dino Barrett
(74) *Attorney, Agent, or Firm*—Apex Juris, PLLC; Tracy M Heims

(57) ABSTRACT

A baggage, which can effectively prevent theft without damaging its utility and can simply be manufactured at low cost by workshop modification from existing baggage. The baggage has a locking device, which can constrain both end portions of a wire by locking operation to form a closed loop. The locking device is fixed to the baggage main body. The locking device can be subassembled in a grip attached to the baggage main body, and the baggage can be simply manufactured by replacing the subassembly with the grip of the existing suitcase.

4 Claims, 10 Drawing Sheets

FIG. 6A
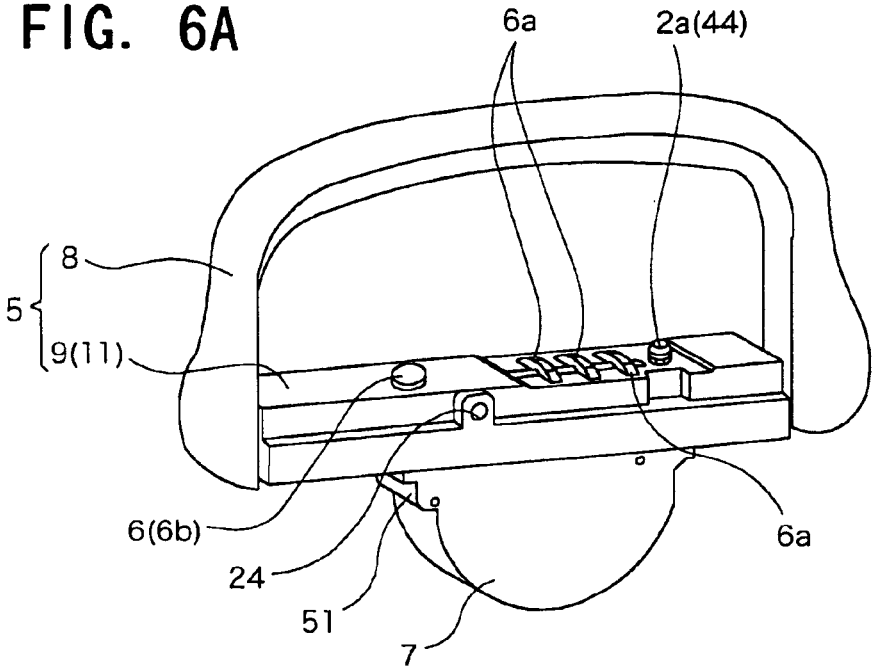
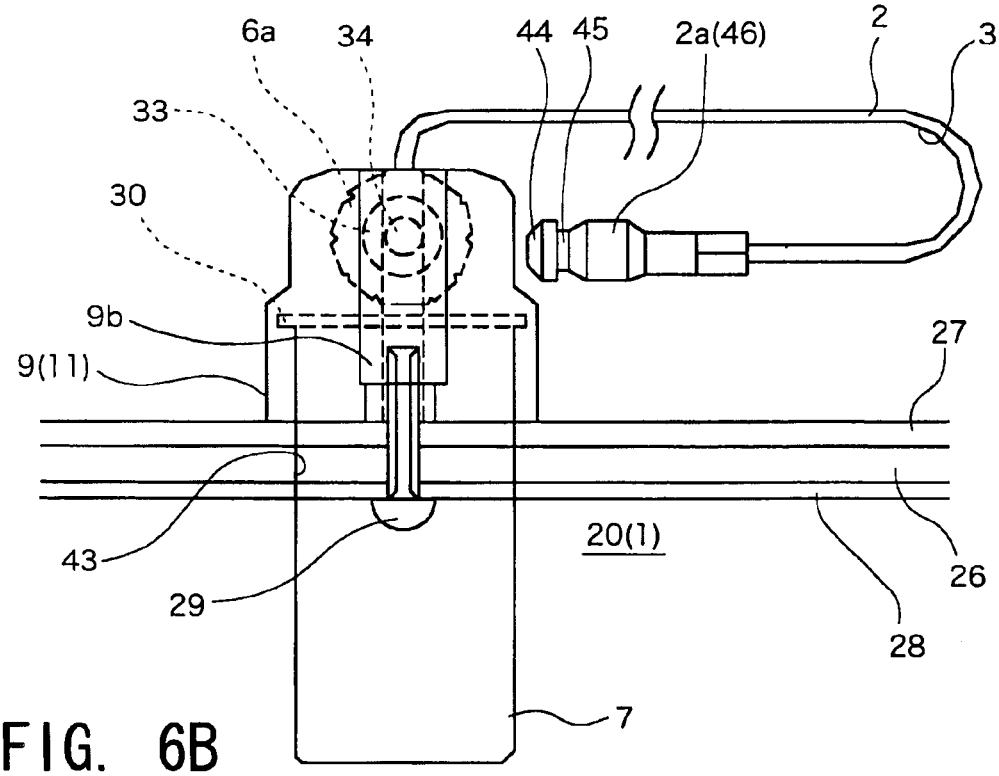
FIG. 6B

FIG. 7A
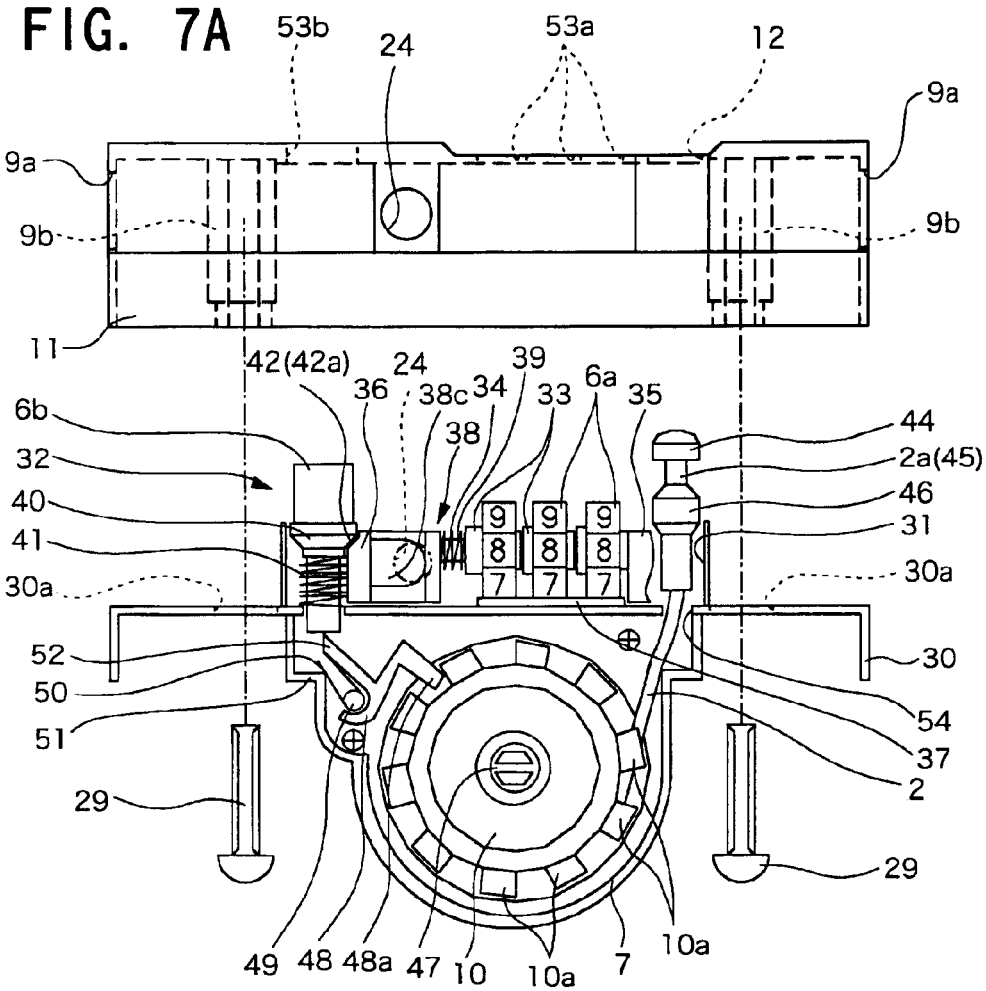
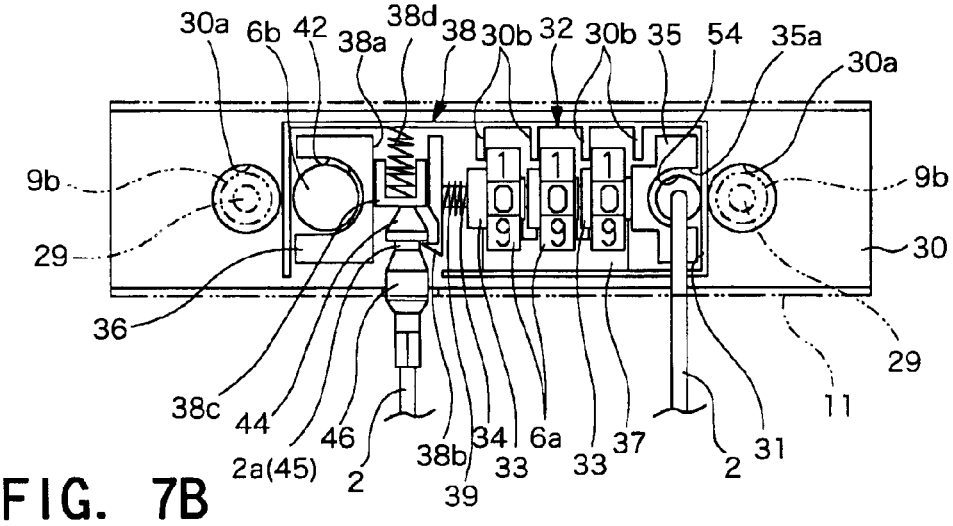
FIG. 7B

FIG. 8A
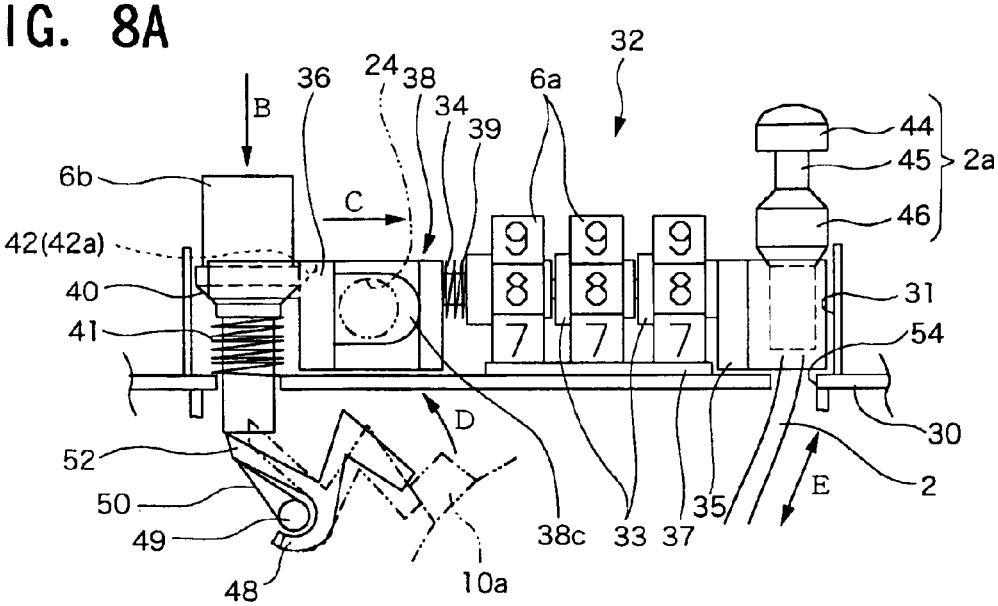
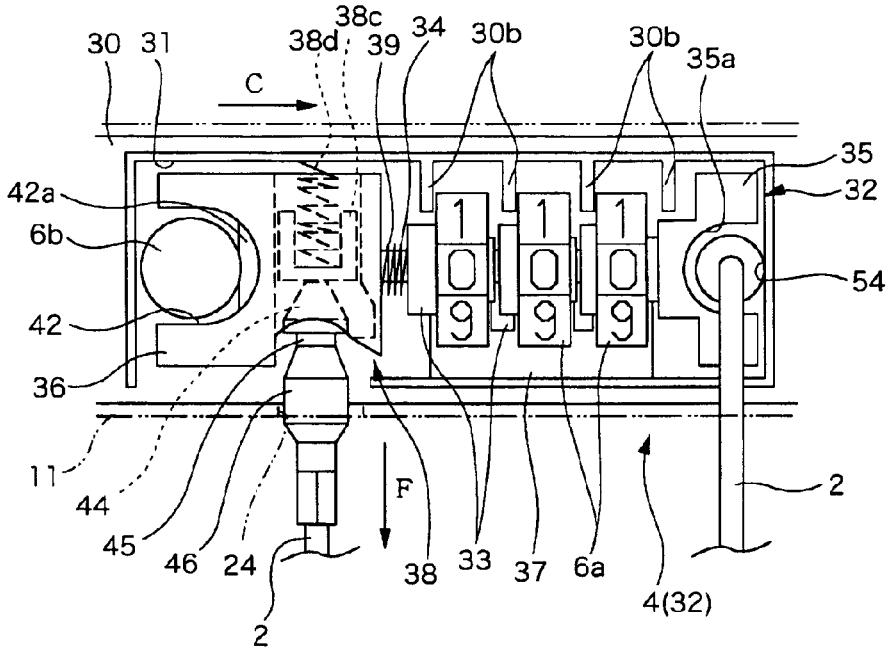
FIG. 8B

BAGGAGE

BACKGROUND OF THE INVENTION

1. Field of the Invention

The present invention relates to a baggage and a grip device installed on a baggage main body.

2. Description of the Related Art

A theft-prevention suitcase, which utilizes a rope as a theft-prevention belt by connecting a rope to a baggage while the rope can be locked and unlocked, is described in Japanese Patent Application Laid-Open No. 11-155623. In this conventional example, in the theft-prevention suitcase, a fit portion and a locking device which can connect an end portion of the rope are provided while exposed to the outside, and a closed loop is formed outside the suitcase by fitting one end of the rope into the fit portion while the other end engages the locking device.

However, the conventional example has a drawback that production takes many man-hours and production cost is also expensive because the fit portion and the locking device are individually formed in the suitcase.

It is necessary that both the end portions of the rope be fixedly connected to the suitcase so that the rope does not disengage even when the suitcase is forcedly hauled. As described above, in the conventional example in which the fit portion and the locking device are separately formed in the suitcase, it is necessary to provide a plurality of reinforcement points in the suitcase. Therefore, the conventional example has another drawback that a baggage housing space is narrowed while the suitcase becomes heavy and difficult to carry by the reinforcement.

SUMMARY OF THE INVENTION

In view of the foregoing, it is an object of the invention to provide a baggage which can effectively prevent the theft without reducing usability while being able to be simply manufactured at low cost by workshop modification from the existing suitcase, and the grip device installed on the baggage main body.

In order to achieve the above-described object, the invention provides a baggage configured to fix a locking device, which can constrain both end portions of a wire by locking operation to form a closed loop to a baggage main body.

According to the invention, the baggage is formed by fixing a locking device to which both end portions of a wire are connected to a baggage main body, and a closed loop is formed by forming the wire in a loop shape outside the baggage main body to constrain the both end portion with the locking device. The locking device can be integrally incorporated in and fixed to the baggage in such a manner that the locking device is bonded to the surface of the baggage main body or screwed in the baggage main body. The wire and the baggage main body are strongly connected to each other by integrating the locking device with the baggage main body, and the wire does not easily disengage the baggage even when the closed loop is forcedly hauled outside the baggage main body.

The locking device satisfies locking function, when one end portion of the wire whose the other end portion is connected can be constrained to form the closed loop with the wire. For example, as shown in FIG. 3B, it is possible that both end portions of the wire 2 are detachable, and it is also possible to use the wire in which one end portion is fixed to a lock case and only the other end portion is detachable.

When a wire storing portion is provided in the locking device to be able to wind and store the wire, a pullout length of the wire toward the outside of the baggage main body can be adjusted, and the usability can be further improved. The connection position of one end portion of the wire and the connection portion connecting the other end portion are arranged so as to be close to the locking device. Therefore, a size of the closed loop can be minimized and the overall length of the wire can be shortened, when the wire is winded around a structure such as the pillar.

With reference to the installation of the locking device in the baggage main body, for example, it is possible that the locking device is fitted in and fixed to the inside of the baggage main body having a proper thickness surrounding a hollow portion which becomes the baggage housing space. In this case, when the workshop modification of the existing baggage is performed, the manufacturing is easy to perform and manufacturing cost can be suppressed to a lower level. Further, because the both end portions of the wire are held by one point of the baggage main body to which the locking device is fixed, securing the strength does not reduce ease of carry.

In installing the locking device in the baggage main body, the wire whose one end is connected to the locking device is previously pulled out to the outside of the baggage main body. Alternately, as described above, in the case where the wire storing portion is formed, the hole through which the wire can be inserted is made in the baggage main body. Therefore, the wire can be formed so as to be able to be pulled out to the outside of the baggage main body. Similarly, it is possible that the connection portion of the locking device is directly exposed from the outside surface of the baggage main body to the outside of the baggage main body, or it is possible that the hole for exposing the locking device is made in the baggage main body.

A point where the locking device is installed in the baggage main body can be properly determined in consideration of weight balance of the baggage main body or the usability. In the case where the locking device is installed in a grip provided in the baggage main body, the locking device can be provided without reducing an appearance of the baggage while a part of the locking device is protruded from the baggage main body. Therefore, the locking device can be prevented from protruding to the inside of the baggage housing space of the baggage main body in the case where the locking device is larger than a thickness of the baggage main body, and locking and unlocking operability can be improved in the case where the locking device is formed by a dial type locking device. It is desirable that connection direction of the pulled-out wire and the locking device is set on the side of the baggage main body so that the wire is easily winded around the standing pillar or the like.

The above-described object can be also achieved by provision of a grip device which is installed on a baggage main body comprising a grip having a hand grip portion and a fixing portion which fixes the grip device to the baggage main body, and a locking device which is installed in the grip and can constrain both end portions of a wire by locking operation to form a closed loop.

A grip can be fixed to the baggage main body by a fixing portion with the large strength that can bear the carry in such a manner that the grip device including a subassembly in which the locking device is installed in the grip is installed in the baggage main body. As described above, in the case where the wire storing portion is fitted to the baggage main body, the locking device can be more strongly fixed to the baggage main body.

In the storage of the pulled-out length of the wire in the wire storing portion, storage efficiency can be improved by, for example, winding the wire about a winding member such as a shaft, and it is also possible to utilize a simple automatic winding device using a spiral spring. In this case, winding operation and pullout operation can become smooth to improve the usability by guiding the wire so that the wire substantially becomes a tangential line relative to a winding position, for example, a rotational locus of the winding member. The guide of the wire to the winding position can be performed by providing a guide opening at the corresponding position of a cover member covering the locking device, namely, by utilizing the fixing portion which fixes the grip to the baggage main body. In the case where a hand grip portion is rotatably connected to the cover member, it is possible to increase a degree of freedom of the arrangement of the components exposed to the outside of the cover member, which include a locking and unlocking operation portion and the connection portion which constrains the free end portion of the wire by the locking operation with the locking and unlocking operation portion in addition to the guide opening, and operability of the locking device can be also improved.

BRIEF DESCRIPTION OF THE DRAWINGS

FIG. 2 is a sectional view of a substantial part in the baggage of the invention.

FIG. 3 is a perspective view showing a subassembly.

FIG. 4 is a perspective view showing a state in which a wire is wound around a pillar.

FIG. 6 shows a grip device, FIG. 6A is a perspective view of the grip device, and FIG. 6B is a view for explaining the state in which the grip device is fixed to a baggage main body;

FIG. 7 shows a locking device, FIG. 7A is a sectional front view of the substantial part showing the state in which the locking device is installed on a base portion, and FIG. 7B is a sectional plan view of the substantial part;

FIG. 8 is a view for explaining action of the locking device, FIG. 8A is a sectional front view of the substantial part, and FIG. 8B is a sectional plan view of the substantial part;

FIG. 9 is a view for explaining the installed state of a dial, a sleeve, a shaft, and a plate spring, FIG. 10 shows a variation of another embodiment.

DESCRIPTION OF THE PREFERRED EMBODIMENTS

Figure 1:
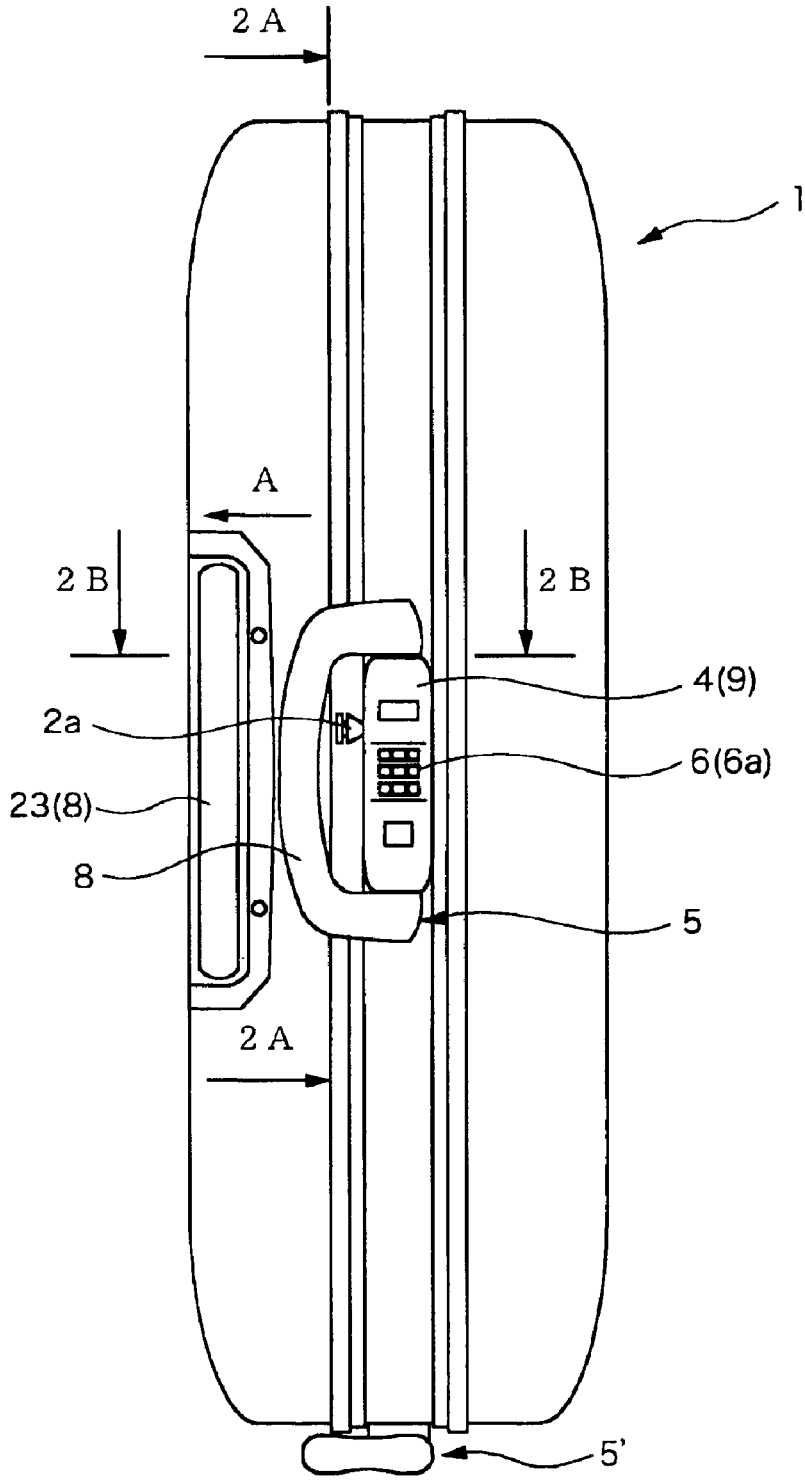
FIG. 1 is a plan view showing a baggage of the invention.
Figure 2A:
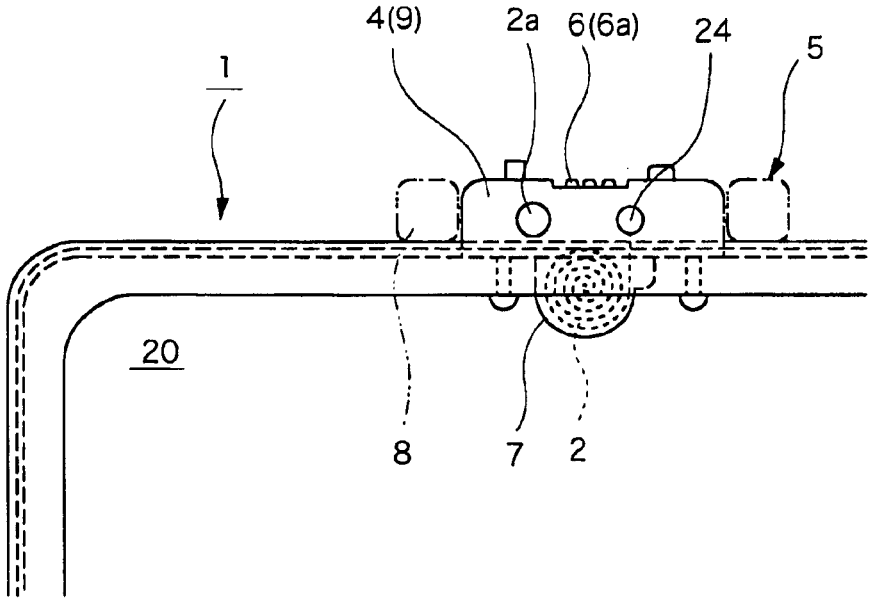
FIG. 2A is a sectional view taken on line 2A—2A of FIG. 1.
Figure 2B:
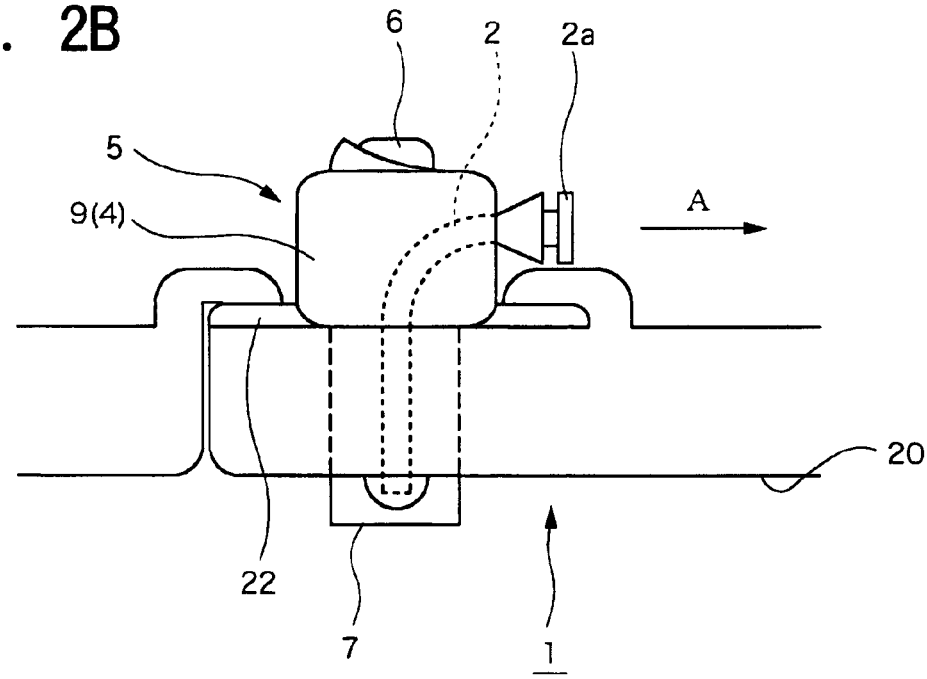
FIG. 2B is a sectional view taken on line 2B—2B of FIG. 1.

FIGS. 1 to 4 show an embodiment of the invention. In the embodiment, the baggage is the suitcase whose baggage main body 1 is made of ABS resin, and a plurality of wheels 21 is rotatably attached beneath the main body 1 in which a baggage housing space 20 is formed. In the baggage main body 1, the baggage housing space 20 can be opened by a hinge (not shown) provided in a lower portion, grips 5 and 5' are included at two points of an upper surface and one side surface, and an attachment which can attach and remove the wheel (not shown) is formed on the other side surface opposite to one side surface of the baggage main body 1 where the grip 5' is formed. Therefore, the suitcase can be easily carried without lifting the baggage main body 1 by the wheels 21 on the lower surface side when the suitcase is pulled by the grip 5 on the upper surface side, and by attaching the wheel to the attachment formed on the opposite side surface when the suitcase is pulled by the grip 5' on one side surface side. In FIG. 2B, the numeral 22 designates a packing, which is bonded to an outside surface of a metal frame of the baggage main body 1.

The grip 5 includes a hand grip portion 8 and a base portion 9 (fixing portion to the baggage main body) which supports the hand grip portion 8, and a spring (not shown) is attached between the hand grip portion 8 and the base portion 9 so that the hand grip portion 8 is rotated to a shelter position along the baggage main body 1 during nonuse. In FIG. 1, the numeral 23 designates a handle which is formed to arrange the hand grip portion 8 on an upper end of a drawing rod (not shown) telescopic by a telescope structure, and the baggage main body 1 can be carried with the baggage main body 1 tilted by pulling out the drawing rod from the baggage main body 1 to pull the baggage main body 1 with the handle 23.

A locking device 4 is attached to one of grips 5 and 5'. In the locking device 4, the base portion 9 of the grip 5 is utilized as a key case, and a locking and unlocking operation portion 6 such as a dial for locking and unlocking operation 6*a* is formed on the upper surface. As shown in FIG. 2, in the locking device 4, a wire storing portion 7 is formed under the base portion 9 while expanded and protruded, and a wire 2 is stored in the wire storing portion 7 while winded.

As shown in FIG. 2, while the locking device 4 is fixed to the baggage main body 1, the locking and unlocking operation portion 6 is exposed on the surface of the baggage main body 1 and the wire storing portion 7 is fit to and stored in the baggage main body 1.

One end of the wire 2 is fixed to the locking device 4 and a locking portion 2*a* is formed at the other end of the wire. After the locking portion 2*a* of the wire 2 is inserted into a wire receiving hole 24 which is made in the base portion 9, a lock part (connection part, not shown) is locked in the locking portion 2*a* of the wire 2 to prevent the locking portion 2*a* from detaching from the wire receiving hole 24, and the wire 2 becomes the locked state by rotating the dial 6*a* of the locking and unlocking operation portion 6 to a locked rotation position.

Therefore, in the embodiment, the wire 2 is stored in the wire storing portion 7 while winded during nonuse, and only a leading end of the locking portion 2*a* is exposed from a sidewall of the base portion.9. When a user leaves from the baggage in this state, firstly, unreeling the wire 2 by pulling out the locking portion 2*a* in a direction of an arrow A shown in FIGS. 1 and 2A, for example, the wire 2 is winded around a structure 25 such as a chair or pillar located near the baggage, then inserting the locking portion 2*a* into the wire receiving hole 24, and then rotating the dial 6*a* to an arbitrary rotation position. Herewith, since the baggage is bound about the structure 25, there is no fear of baggage thief and the like (see FIG. 4A).

When the dial 6*a* is rotated to a predetermined unlocked rotation position from this state, the locking portion 2*a* can be detached. Then, the baggage can be carried by winding and storing the wire 2 in the wire storing portion 7.

Figure 3A:
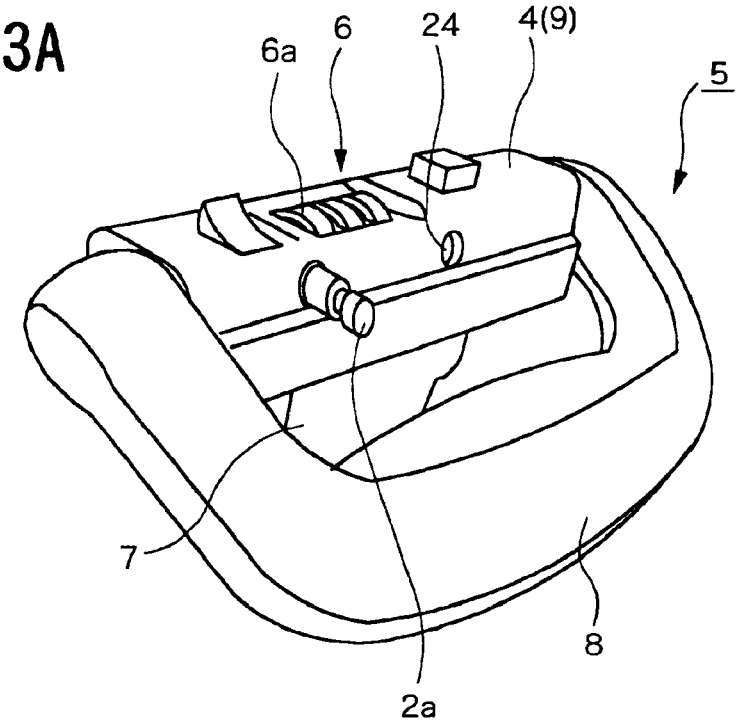
FIG. 3A shows the subassembly having a wire storage portion.

Although the dial lock was used as locking and unlocking means in FIG. 1, the invention is not limited to the dial lock. It will be also appreciated that a normal key cylinder lock or the like is used in the invention. As shown in FIG. 3A, by preparing a subassembly in which the locking device 4 is previously incorporated in the base portion 9 of the grip 5, and manufacturing a suitcase, which the subassembly is attached by a screw or the, mass production efficiency can be improved.

Figure 3B:
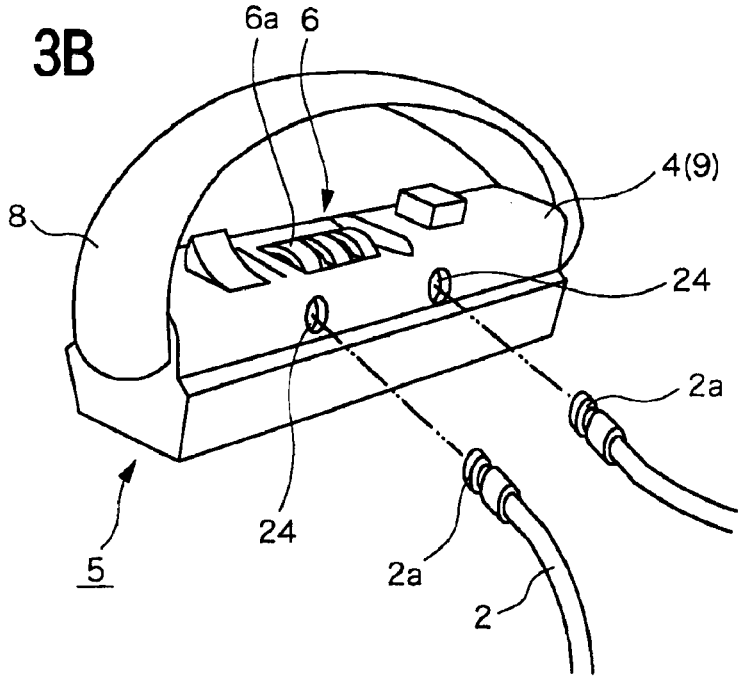
FIG. 3B shows the subassembly having no wire storage portion.
Figure 4A:
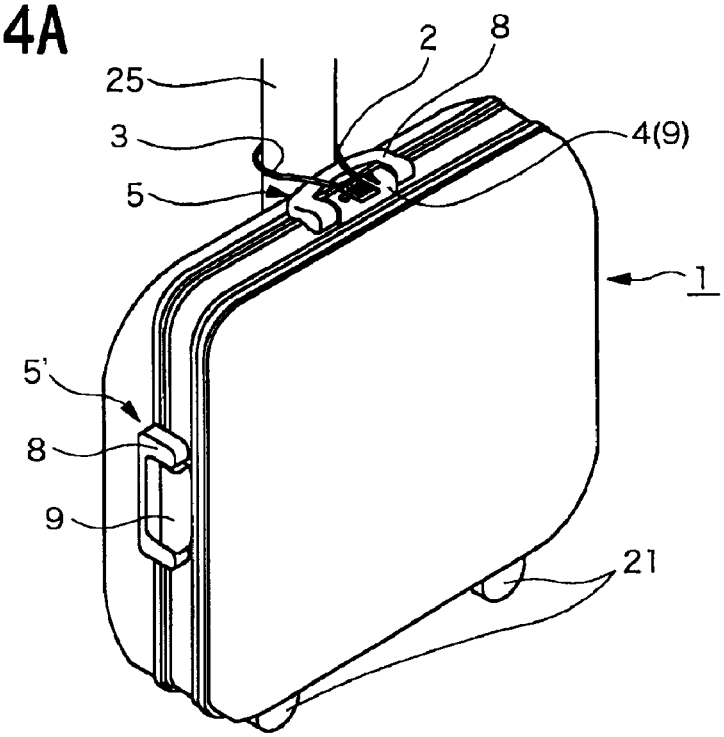
FIG. 4A shows the state in which the baggage shown in FIG. 1 is locked.
Figure 4B:
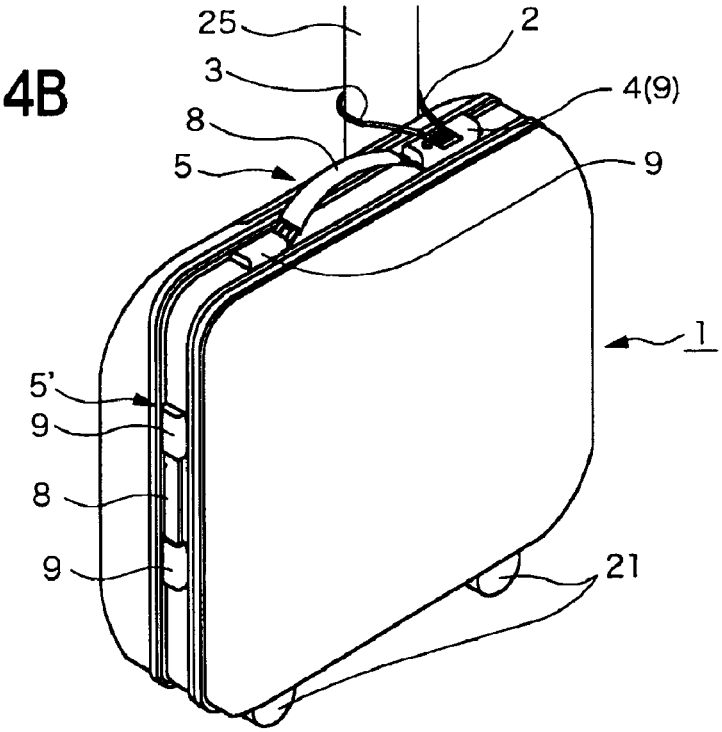
FIG. 4B shows a variation of FIG. 1.

Further, although the base portion 9 was arranged at an intermediate portion of the hand grip portion 8 in the above embodiment, when the base portions 9 are arranged corresponding to the both end portions of the hand grip portion 8, one of the base portions 9 can be utilized as the locking device 4 as shown in FIG. 4B. As shown in FIG. 3B, when the both end portions of the wire 2 are formed while being detachable from the locking device 4, it is not necessary to form the wire storing portion 7 and miniaturization can be further achieved.

Figure 5:
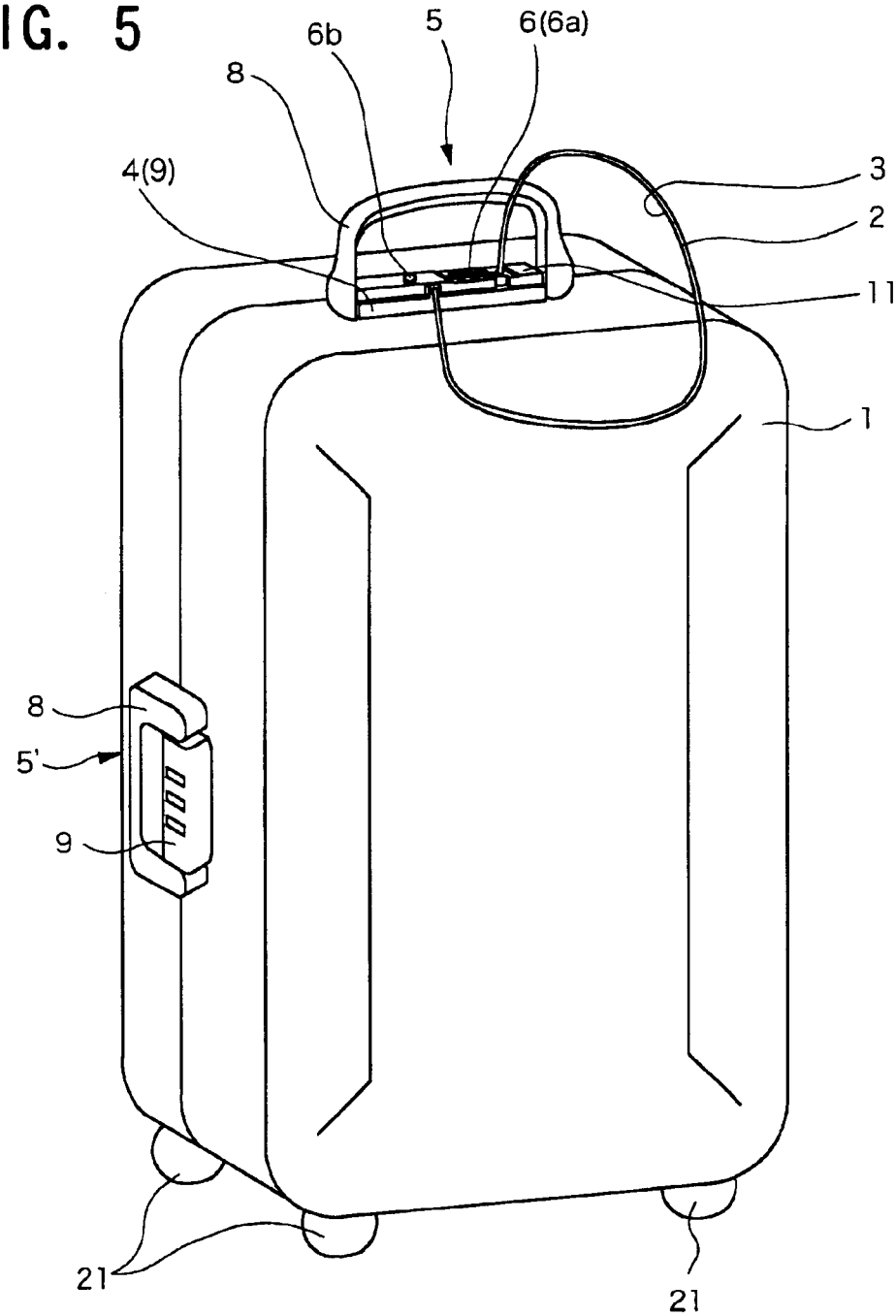
FIG. 5 is a perspective view showing the baggage of another embodiment of the invention.

FIGS. 5 to 9 show another embodiment of the invention. In the embodiment shown in FIGS. 5 to 9, the baggage is the so-called soft carrier case including the baggage main body 1, which is formed by sewing cloth, made of nylon in a box shape. As shown in FIG. 5A, the plurality of wheels 21 is attached on the lower surface side. The main body can be opened while a girth, namely, a thickness direction of the baggage main body 1 is divided into two parts. A thin plate-like frame 26 made of an EVA material (ethylene.vinyl.acetate mixing material) and the like, are provided all around the girth for the purpose of reinforcement. Therefore, as shown in FIG. 5, the grip 5 arranged on the upper surface side of the girth of the baggage main body 1, the grip 5' on one side surface and the wheels 21 are fixed to the frame 26 arranged between an outer material 27 and a backing cloth 28 which are made of nylon or the like, and firmly attached to the baggage.

As shown in FIG. 6A, the grip 5 on the upper surface side has the hand grip portion 8 and the base portion 9 (fixing portion to the baggage main body) to which the hand grip portion 8 is rotatably connected. The hand grip portion 8 is formed by molding synthetic resin in a substantial U-shape, and a rotating shaft (not shown) is projected from both end portion of the hand grip portion 8 with the both end portions opposite to each other. Bending a plate material made of aluminum to drop the sidewall from a periphery of a ceiling wall forms the base portion 9, and the base portion 9 has a substantially reverse U-shape. As shown in FIG. 7A, a rotational shaft inserting hole 9*a* is made in both sidewalls in a lengthwise direction. Therefore, the hand grip portion 8 is rotatably connected to the base portion 9 by inserting the rotational shaft into the rotational shaft inserting hole 9*a* to install the hand grip portion 8 so as to straddle the lengthwise direction of the base portion 9.

A cylindrical boss 9*b* which a screw groove is provided inside is protruded downward, namely, toward the baggage main body 1 from the ceiling wall of the base portion 9. As shown in FIG. 6B, the grip 5 is fixed to the frame 26 in such a manner that a grip fixing screw 29 pierces from the baggage housing space 20 side of the baggage main body 1 through the outer material 27, frame 26, and backing cloth 28 to be screwed in the boss 9*b*. Therefore, in this state, the hand grip portion 8 is rotatably connected to the baggage main body 1 through the base portion 9. Because the other end of a torsion spring (not shown) whose one end is locked in the sidewall of the base portion is attached to the rotational shaft, the hand grip portion 8 is biased in a predetermined rotational direction relative to the base portion 9, and the hand grip portion 8 takes a fell-down attitude along the outer surface of the baggage main body 1 during nonuse. The locking device 4 is installed in the base portion 9 by utilizing the hollow portion of the inside.

Figure 9A:
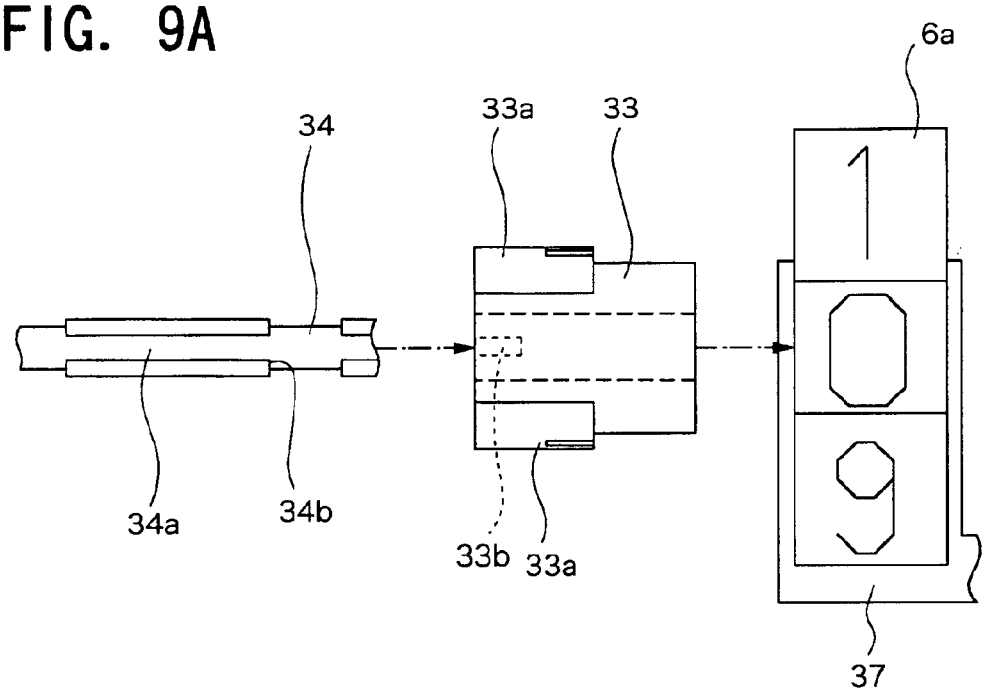
FIG. 9A is an exploded plan view.
Figure 9B:
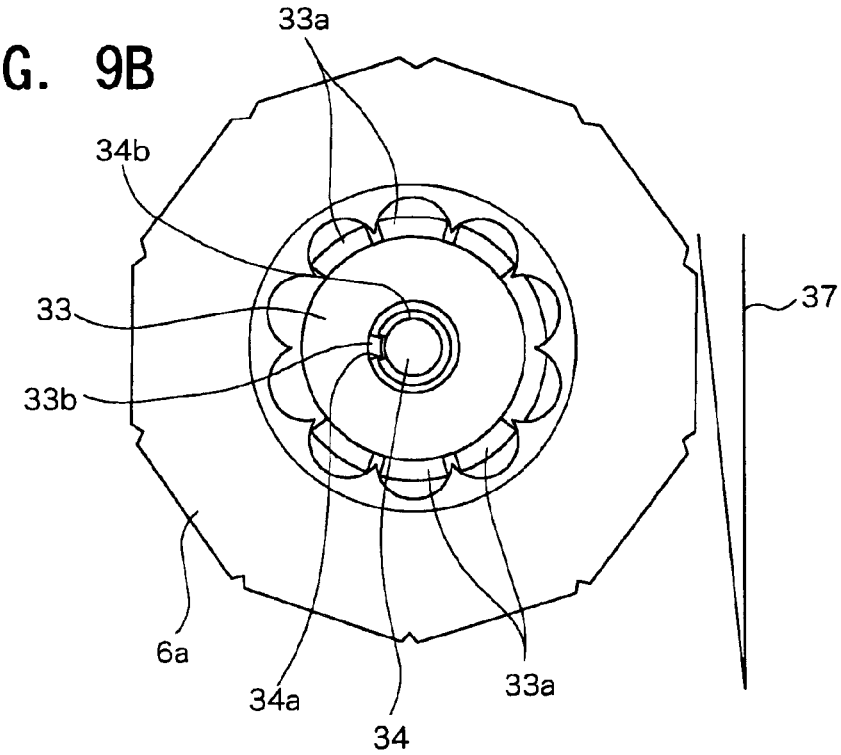
FIG. 9B is a side view.

As shown in FIGS. 7 to 9, the locking device 4 is the so-called wire lock, and the locking device 4 includes a base plate 30 in which a boss inserting through-hole 30*a* fitted to the bass 9*a* is made. A lock storing portion 31 is formed in the upper portion of the base plate 30, and the wire storing portion 7 is formed in the lower portion of the base plate 30. The lock storing portion 31 is formed by separating the space with the wall surface vertically provided from the base plate 30, and the lock storing portion 31 stores a dial lock 32.

The dial lock 32 includes dials 6*a*, 6*a*, and 6*a* which are arranged in three lines in parallel, sleeves 33 which are attached to each of the dials 6*a* while not being able to be relatively rotated, a shaft 34 which pierces the sleeves 33, a shaft support 35 which supports the leading end of the shaft 34, and a latch 36 which fixed to a base end of the shaft 34. The dial 6*a* has a substantially cylindrical shape while numeric characters of 0 to 9 are attached onto the outside surface of the dial 6*a* at regular intervals. The dial 6*a* is biased upward from the base plate 30 side located on the lower side by a plate spring 37. The dials 6*a* are respectively arranged at the predetermined positions of the lock storing portion 31 at even pitches by a dial partition plate 30*b* formed in the lock storing portion 31. As shown in FIG. 9A, the sleeve 33 has the substantially cylindrical shape, a rotation stop projection 33*a* fitted to an inside wall of the dial 6*a* is provided in the surface of an outer wall of the sleeve 33, and a locking projection 33*b* is provided at the position corresponding to the specific numeric character of the dial 6*a* in the surface of the internal wall. The rotation stop projection 33*a* is formed while a region corresponding to the locking projection 33*b* is removed so that the position of the locking projection 33*b* can be easily seen from the outside in installing the sleeve 33.

As shown in FIG. 9A, the shaft 34 has a groove 34*a* for avoiding contact with the locking projection 33*b* across the overall length in the lengthwise direction. In the shaft 34, a notch 34*b* having the same depth as the groove 34*a* all around the shaft 34 is provided in the region corresponding to the locking projection 33*b* of each sleeve 33. The shaft support 35 is the block-shaped member in which a shaft support hole (not shown) supporting the leading end of the shaft 34 is made, and the shaft support 35 is supported in the wall surface of the lock storing portion 31 and arranged at the predetermined position of the lock storing portion 31. The shaft support hole is formed longer than the leading end of the shaft 34 on the unlocking operation position side of the latch 36 so that the latch 36 can be moved between the locking operation position and the unlocking operation position as described later, namely so that the leading end of the shaft 34 can be moved to the deeper position with the latch 36. In FIGS. 7 and 8, the numeral 35*a* designates a support portion, which supports the locking portion of the wire from the circumferential direction when the wire is stored as described later.

The latch 36 is the block-shaped member including a connection portion 38 connected to the locking portion 2*a* in using the wire. The latch 36 is guided by the wall surface of the lock storing portion 31 and stored in the lock storing portion 31 while the latch 36 can be moved in the direction in which the latch 36 is caused to be close to and separated from the shaft support 35. The connection portion 38 includes a though-hole 38*a* which pierces the sidewall of the latch 36, a locked portion 38*b* which is formed in the end portion of the through-hole 38*a* by drilling the internal wall of the though-hole 38*a* along the latch 36 moving direction in accordance with the shape of the locking portion 2*a*, a slide plate 38*c* which is slidably inserted into the through-hole 38*a*, and a slide plate compression spring 38*d* in which one end abuts on the wall surface of the lock storing portion 31 and the other end presses the slide plate 38*c* against the end portion on the locked portion 38*b* side of the through-hole 38*a*. In FIGS. 7 and 8, the numeral 39 designates a latch compression spring which biases the latch 36 in the direction in which the latch 36 is caused to be separated from the shaft support 36, and the latch 36 is arranged at the locking operation position where one sidewall of the latch 36 abuts on the wall surface of the lock storing portion 31 in the normal state.

An operation button 6*b*, which operates the locking device 4, is installed in the latch 36. The operation button 6*b* is a pin-shaped member which is moved downward, namely, in the direction orthogonal to the latch 36 movable direction by pressing operation. A diameter enlarged portion 40 in which the outer diameter is gradually enlarge toward the anti-pressing direction, namely, upward is formed in the outer periphery of the operation button 6*b*, and the operation button 6*b* is biased in the anti-pressing direction by attaching an operation button compression spring 41 whose one end abuts on the base plate 30. In the latch 36, an operation button storing portion 42 which stores the operation button 6*b* is provided in the vertical direction, namely, in the direction orthogonal to the latch 36 movable direction, and an engaged portion 42*a* which includes an inclined surface engaging the diameter enlarged portion 40 is formed in the upper end of the operation button storing portion 42.

Therefore, as shown in FIG. 8, when the operation button 6*b* is pressed by opposing the operation button compression spring 41 (the operation button 6*b* is moved in the direction of an arrow B in FIG. 8A), the latch 36 can be moved against the latch compression spring 39 toward the shaft support 35 side by the engaged portion 42*a* which is slid with the diameter enlarged portion 40. In this state, when the locking projection 33*b* of the sleeve 33 is located at the position along the groove 34*a* of the shaft 34, that is when the dials 6*a* are located at the rotation position which shows a combination of the numeric characters indicating a predetermined unlocking code, the latch 36 is moved with the shaft 34 to the unlocking operation position on the shaft support 35 side (movement in the direction of an arrow C in FIGS. 8A and 8B). When the dials 6*a* are located at the rotation position showing the combination of the numeric characters which do not correspond to the predetermined unlocking code, the locking projection 33*b* of the sleeve 33 engages the notch 34*b* of the shaft 34 and the shaft is caused not to be movable. Consequently, the engaged portion 42*a* prevents the diameter enlarged portion 40 from moving, so that the operation button 6*b* can not be also pressed.

As shown in FIG. 7A, the wire storing portion 7 is the case having the hollow portion whose shape is a circle when viewed from the side face, and a reel (winding member 10) is rotatably stored inside the wire storing portion 7. The wire is winded and stored inside the wire storing portion 7 by winding the wire 2 about the reel 10. The size of the reel 10 is set larger. Namely, for example, in order to be able to store the wire 2 having the length of about 2 m, the lower end of the wire storing portion 7 is protruded more downward than the bottom surface of the base portion 9. In the state in which the grip 5 is attached to the baggage main body 1, as shown in FIG. 6, the lower end of the wire storing portion 7 pierces the outer material 27, the frame 26, and the backing cloth 28 and reaches the baggage housing space 20. Therefore, a wire storing portion inserting opening 43 which inserts the wire storing portion 7 is made in the baggage main body 1 while piercing the outer material 27, the frame 26, and the backing cloth 28, and the periphery of the sidewall of the wire storing portion 7 is supported by the frame 26, which allows the grip 5 to be more strongly attached to the baggage main body 1.

The wire 2 stored in the wire storing portion 7 is formed by twisting a plurality of wire rods made of metal thin wire, one end of the wire 2 is connected to the reel 10, and the locking portion 2*a* is formed at the other end. As shown in FIG. 6B, the locking portion 2*a* includes a steeple portion 44 at the leading end, a locking step portion 45 having the smaller diameter is formed under the steeple portion 44, and the thick diameter portion 46 having the same diameter as the maximum diameter of the steeple portion 44 is formed under the locking step portion 45.

As shown in FIG. 7A, the reel 10 is rotatably fitted to the wire storing portion 7 while the rotational center is journaled by a shaft body 47. Both end portions of the spiral spring (not shown) are attached to the shaft body 47 and the reel 10 respectively, and the reel 10 is biased to the predetermined rotation position by the spiral spring. Therefore, when the reel 10 is set to the predetermined rotation position while the wire 2 is pulled out, or when the spiral spring is compressed slightly toward the wire 2 pullout direction from the predetermined rotation position while the wire 2 is pulled out, the reel 10 can be rotated by biasing force of the spiral spring to automatically wind the pulled-out wire 2 about the reel 10 and the wire 2 can be stored in the wire storing portion 7.

In order to maintain the state in which the wire 2 is pulled out against the biasing force of the spiral spring, a plurality of rotation stop pieces 10*a* is formed in the circumferential direction in the reel 10, and a hook member 48 including a hook portion 48*a* attachable to the rotation stop piece 10*a* is rotatably provided in the wire storing portion 7. As shown in FIGS. 7A and 8A, the hook member 48 is rotatable about a hook holding pin 49 protruded from the sidewall of the wire storing portion 7, and the hook member 48 can be rotated between a rotation stop position where the hook portion 48*a* shown by a chain double-dashed line in FIG. 8A is locked in the rotation stop piece 10*a* and a releasing position where the hook portion shown by a solid line in FIG. 8A is unlocked from the rotational area of the rotation stop piece 10*a*. A torsion spring 50 is also attached to the hook holding pin 49, one end of the torsion spring 50 is attached to a torsion spring support portion 51 of the wire storing portion 7, and the other end of is attached to the hook member 48, which allows the hook member 48 to be biased to the rotation stop position.

In order that the wire 2 can be pulled out from the wire storing portion 7 and the pullout length can be adjusted, an operation portion 52 is provided in the hook member 48. The leading end of the operation portion 52 is arranged under the operation button 6*b*, and the downward moving force of the operation button 6*b* is converted into the rotating force by the operation portion 52 to rotate the hook member 48 in the releasing position direction. As described above, in the case where the dial 6*a* is located at the rotation position, which does not correspond to the unlocking code, the operation button 6*b* can not be moved downward. Consequently, because the torsion spring 50 maintains the hook member 48 to the rotation stop position, the pullout length of the wire 2 from the reel 10 can not be changed. On the contrary, in the case where the dials 6*a* are located the rotation positions corresponding to the locking code, because the hook member 48 can be moved to the releasing position by the operation button 6*b*, the pullout length of the wire 2 from the reel 10 can be changed.

In order to enable the pullout of the wire2, the operation of the locking device 4 and the like, as shown in FIG. 7A, an operation opening 53 made of the wire pullout opening (guide opening 12) through which the wire 2 pulled out from the reel 10, a dial operation opening 53*a* which enables the operation of the dial 6*a* and a pressing button operation opening 53*b* which enables the operation of the pressing button are arranged on the upper surface of the base portion 9. A wire inserting through-hole 54 arranged substantially directly below the wire pullout opening 12 is made in the base plate 30. After the wire 2 pulled out from the wire storing portion 7 passes through the wire inserting through-hole 54 to be pulled out to the upward direction of the base plate 30, the wire 2 is pulled out to the outside of the grip 5, namely, the outside of the baggage main body 1 by further passing through the wire pullout opening 12. As shown in FIG. 7A, in order to minimize the length of the wire 2 pulled out from the wire pullout opening 12 while the operability of the dial 6*a* is improved, the dial operation opening 53*a* and the wire pullout opening 12 are arranged at the position slightly lower than the upper end surface of the base portion 9.

While the diameter of the wire inserting through-hole 54 is formed to be smaller than that of the thick diameter portion 46 of the locking portion 2*a*, the locking portion 2*a* is formed to be longer than a distance between the base plate 30 and the upper surface of the base portion 9, so that the locking portion 2*a* is never pulled in the hollow portion of the base portion 9 or the wire storing portion 7. Further, the wire pullout opening 12 and the wire inserting through-hole 54 guide the inserted wire 2 to the position which makes the tangential line relative to the rotational locus of the reel 10, so that the wire 2 can be smoothly pulled out from the reel 10 or the wire 2 can be smoothly pulled in the reel 10.

In order to lock the locking portion 2*a* which is of the leading end of the wire 2 pulled out from the wire pullout opening 12 to form the closed loop 3 with the wire 2 outside the baggage main body 1, the wire receiving hole 24 is provided in the sidewall of the base portion 9, namely, a crosswise direction. The through-hole 38*a* and the slide plate 38*c* of the connection portion 38 are arranged at the back of the wire receiving hole 24. As shown by the chain double-dashed line in FIG. 7A, when the latch 36 is located at the locking operation position, the locking portion 2*a* overlaps the locked portion 38*b* when viewed in the plan view.

As shown in FIG. 7B, since the sidewall surface of the locked portion 38*b* facing the wire receiving hole 24 is formed on an inclined plane which is inclined in the direction of the inside of the base portion 9 toward the through-hole 38*a*, when the locking portion 2*a* inserted from the wire receiving hole 24 presses the inclined plane, the latch 36 is moved onto the unlocking operation position side by a component of force generated in the direction orthogonal to the pressing force, which enables the locking portion 2*a* to proceed into the through-hole 38*a*. When the steeple portion 44 proceeds into the through-hole 38*a* and the locking portion 2*a* is pressed to the position where the locking step portion 45 corresponds to the inclined plane, namely, the locked portion 38*b*, the latch 36 is moved to the position where an end edge of the inclined plane abuts on the locking step portion 45 on the locking operation position, and the locked portion 38*b* is locked in the step between the locking step portion 45 and the steeple portion 44. This allows the locking portion 2*a* to be connected to the connection portion 38 to be retained. When the dials 6*a* are rotated to the rotation positions which do not correspond to the unlocking code, the movement of the latch 36 to the unlocking operation position is restricted, and the locking portion 2*a* is connected to the connection portion 38 while the locking portion 2*a* can not be detached.

In order to unlock the locking portion 2*a* from the connection portion 38, the operation button 6*b* is pressed while the dials 6*a* are rotated to the position corresponding to the unlocking code. Therefore, the latch 36 is moved toward the unlocking operation position (in the direction of an arrow C in FIG. 8B) to release the locked state between the locking step portion 45 and the locked portion 38*b*. When the wire 2 is pulled in the direction of an arrow F in FIG. 8B, the locking portion 2*a* can be pulled out of the connection portion 38, namely, the wire receiving hole 24.

Consequently, in order to connect the baggage main body 1 including the grip 5 to the structure such as the pillar, at first the grip 5 is oriented upward, that is that a hand of the user is directly released from the grip 5 arranged upward during carrying the baggage, the dials 6*a* are caused to correspond to the unlocking code, the operation button 6*b* is pressed to move the hook portion 48*a* to the releasing position, and the locked state between the hook portion 48*a* and the rotation stop piece 10*a* is released. Then, the wire 2 is pulled out from the wire storing portion 7 against the biasing force of the spiral spring while the locking portion 2*a* is held. The pullout of the wire 2 is performed only by operating the dial 6*a* and the operation button 6*b* on the upper surface side of the base portion 9, so that the operability is excellent. Further, since the direction in which the wire 2 is pulled out from the wire pullout opening 12 is set upward, the baggage can be supported by utilizing dead-weights of the baggage and the loads in the baggage housing space 20, and the wire pullout operation is also simple. When the wire 2 is pulled out to the length of the extent that the wire 2 can be winded around the pillar 25, the hand is released from the operation button 6*b* to return the operation button 6*b* to the position before the pressing operation by the operation button compression spring 41, which allows the hook portion 48*a* to be returned to the rotation stop position by the torsion spring 50 to be locked in the rotation stop piece 10*a*. Therefore, it is eliminated that the wire 2 is pulled in the wire storing portion 7 by the biasing force of the spiral spring, so that the length of the wire 2 pulled out from the wire storing portion 7 is maintained.

Then, the pulled-out wire 2 is winded around the pillar 25, the locking portion 2*a* is pressed into the wire receiving hole 24 to be locked in the locked portion 38*b*, and the dials 6*a* are properly rotated to the rotation positions which do not correspond to the unlocking code. The work of pressing the locking portion 2*a* is performed only by directly inserting the wire 2 moving in the crosswise direction by the winding of the wire 2 about the pillar 25 into the wire receiving hole 24 made in the side surface of the base portion 9, so that the trouble can be saved. In this state, the wire 2 forms the closed loop 3 while the pillar 25 is arranged inside the closed loop 3, and the baggage is connected to the pillar 25, so that the baggage is never stolen even if the owner of the baggage leaves the baggage.

Then, in the case where the connection between the pillar 25 and the baggage is released, when the dials 6*a* are rotated to the positions corresponding to the unlocking code to press the operation button 6*b*, the locked state between the locked portion 38*b* and the locking portion 2*a* can be released. In this state, since the locked state between the hook member 48 and the rotation stop piece 10*a* is also released, the wire 2 is stored in the wire storing portion 7 by the biasing force of the spiral spring.

Figure 10A:
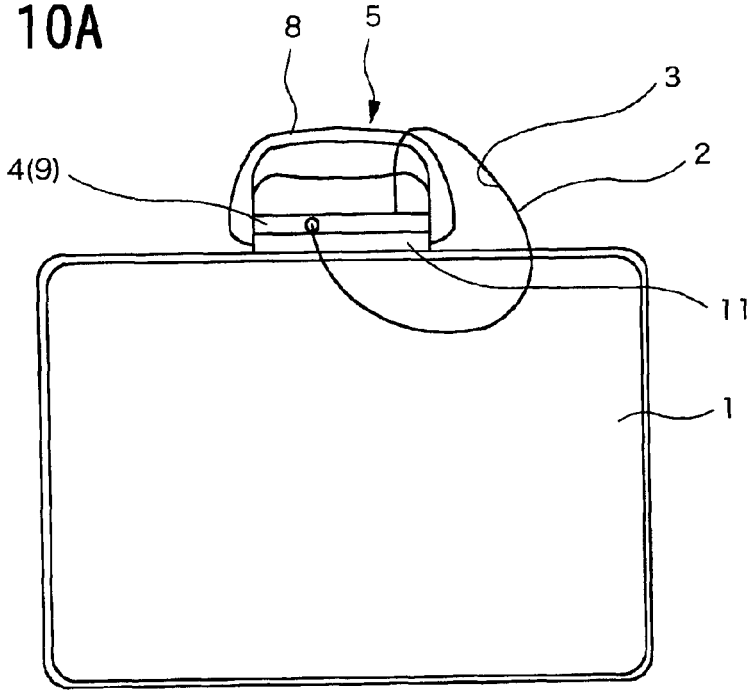
FIG. 10A is a front view showing the state in which the grip device of the invention is installed on a dispatch case.
Figure 10B:
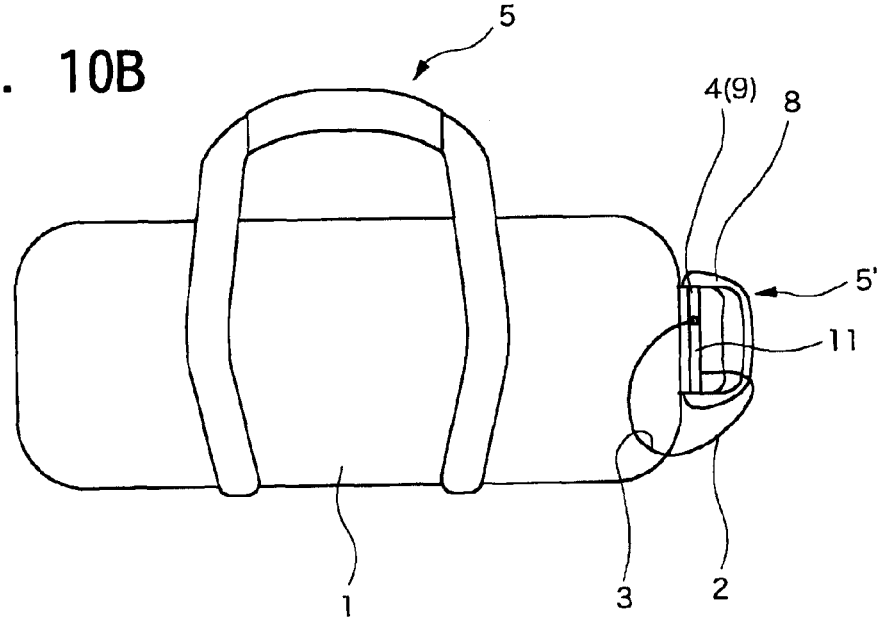
FIG. 10B is a front view showing the state in which the grip device of the invention is installed on a travel bag.

Although the case in which the grip device in which the locking device 4 is subassembled in the grip 5 is installed in the suitcase or the soft carrier case was shown in the above-described embodiments, for example, it is also possible that the grip device of the invention is installed in a dispatch case shown in FIG. 10A or a travel bag shown in FIG. 10*b*. In this case, when the dispatch case is made of aluminum, the reinforcing member such as the frame 26 is not required because the strength is high. In the case of the travel bag having the horizontally long shape, the work of winding the wire 2 about the pillar 25 can be more easily performed by arranging the grip device in the end portion in the lengthwise direction.

As can be seen from the above descriptions, the invention provides the baggage which can have the high theft-prevention function while being simple, low-cost, and usable, so that the security of the baggage can be increased in travel.

What is claimed is:

1. A baggage comprising:

a baggage main body;

a grip unit that has a handle grip and a base portion to be fixed to said baggage main body; and a locking device, installed at said base portion, said locking device has a wire, a locking and unlocking operation portion, a wire storing portion with a winding member therein that stores said wire while not being used, wherein said wire storing portion is located at a lower portion of said locking and unlocking operation portion, said locking device is fixed on said baggage main body while said wire storing portion is inside the baggage main body, said locking and unlocking portion and a wire pullout opening are positioned on said base portion, and whereby one end of said wire can be inserted into a wire receiving hole, positioned on said base portion, and is then fixed to the locking device while the other end is permanently fixed to said winding member, thereby constrained to form a closed loop.

2. A grip device which is installed on a baggage main body, comprising:

a grip unit, comprising a hand grip and a base portion to be fixed to the baggage main body;

a locking device installed at said base portion, said locking device has a wire locking and unlocking operation portion, and a wire storing portion with a winding member therein that stores said wire while not being used, wherein said wire storing portion is located at a lower portion of said locking and unlocking operation portion, said locking device is fixed on said baggage main body while said wire storing portion is inside the baggage main body, said locking and unlocking portion and a wire pullout opening are positioned on said base portion, and whereby one end of said wire can be inserted into a wire receiving hole, positioned on said base portion, and is then fixed to the locking device while the other end is permanently fixed to said winding member, thereby constrained to form a closed loop.

3. The grip device according to claim 2, further comprising:

a cover member provided at the base portion for covering the locking device wherein, said cover member has a guide opening which guides an inserted wire substantially in a tangential direction relative to a rotational locus of the winding member.

4. The grip device according to claim 3, wherein the hand grip portion Is rotatably connected to the cover member.

* * * * *